US005333235A

United States Patent [19]

Ryder

[11] Patent Number: 5,333,235

[45] Date of Patent: Jul. 26, 1994

[54] ELECTRIC HEATER ASSEMBLY FOR ATTACHMENT TO CEILING FANS

[76] Inventor: James Ryder, 1421 Lake Shore Blvd., Little Elm, Tex. 75068

[21] Appl. No.: 555,936

[22] Filed: Jul. 19, 1990

[51] Int. Cl.[5] ..... H05B 1/00; H05B 3/00; F24H 3/04

[52] U.S. Cl. ..... 392/364; 362/92; 392/361; 392/363

[58] Field of Search ..... 219/220, 360–369, 219/379; 362/92; 392/360–369, 370, 371, 373, 374, 375, 376

[56] References Cited

U.S. PATENT DOCUMENTS

| | | | |
|---|---|---|---|
| 449,404 | 3/1891 | Dewey . | |
| 1,226,734 | 5/1917 | Work | 392/361 |
| 1,280,960 | 10/1918 | Carmean et al. | 392/364 X |
| 1,374,658 | 4/1921 | Hohnsbeen | 392/361 |
| 1,383,564 | 7/1921 | Phillipson | 392/366 X |
| 1,388,822 | 8/1921 | Roys | 392/365 X |
| 1,389,235 | 8/1921 | Zieley | 392/365 X |
| 1,399,931 | 12/1921 | Clutts | 392/361 |
| 1,472,124 | 10/1923 | Howe et al. | 392/361 |
| 1,674,017 | 6/1928 | Marsden | 392/361 X |
| 1,687,544 | 10/1928 | Clark et al. | 392/364 X |
| 1,699,201 | 1/1929 | Guth | 392/366 X |
| 1,723,405 | 8/1929 | Carmean | 392/361 |
| 1,756,033 | 4/1930 | Nordan | 392/361 |
| 1,813,023 | 7/1931 | Cheslock et al. | 392/366 X |
| 2,010,322 | 8/1935 | Riddell | 392/364 X |
| 2,239,038 | 4/1941 | Greenfield | 392/361 X |
| 2,262,898 | 11/1941 | MacGregor . | |
| 2,274,935 | 3/1942 | Naul | 392/361 |
| 2,359,021 | 9/1944 | Campbell et al. | 392/364 X |
| 2,411,782 | 11/1946 | Gardes | 392/365 X |
| 2,697,163 | 12/1954 | Spear . | |
| 4,146,776 | 3/1979 | Johansen | 392/364 |
| 4,491,721 | 1/1985 | Davis | 392/379 X |
| 4,504,191 | 3/1985 | Brown . | |
| 4,508,958 | 4/1985 | Kan et al. . | |
| 4,782,213 | 11/1988 | Teal . | |

FOREIGN PATENT DOCUMENTS

| | | | |
|---|---|---|---|
| 459192 | 1/1937 | United Kingdom | 362/92 |
| 486319 | 6/1938 | United Kingdom | 219/220 |

*Primary Examiner*—Anthony Bartis
*Attorney, Agent, or Firm*—Hubbard, Tucker & Harris

[57] ABSTRACT

A heating assembly is provided for attachment to an existing ceiling fan to heat airflow being generated by the fan blades. The heating assembly is adapted to connect to the base of the ceiling fan directly below the blades by means of the centrally located mechanical attachment mechanism associated with the fan and conventionally provided to allow attachment of a light kit thereto. The heating assembly includes a vented housing enclosing on or more electrical filaments, heat tubes or other heating elements arranged to radiate heat outwardly of the vented housing into the airflow generated by the fan blades and electrically connected by electrical leads extending through the attachment mechanism to wiring extending from the ceiling fan, which is normally used for a light kit assembly. The heating apparatus may also include an on/off switch and thermostat control located on the fan or at a remote location.

4 Claims, 2 Drawing Sheets

ELECTRIC HEATER ASSEMBLY FOR ATTACHMENT TO CEILING FANS

BACKGROUND OF THE INVENTION

The present invention is directed to ceiling fan apparatus and more particularly to heating apparatus for attachment to ceiling fans.

Conventional ceiling fans are used only in warm temperatures to enhance cooling ventilation. A conventional fan is virtually useless in cool temperatures because the effect of circulating warm air near the ceiling is offset by the cooling effect of the additional air movement.

Some prior art devices have attempted to include a heating element as part of a ceiling fan to provide additional heat to the air being circulated. U.S. Pat. No. 4,508,958, granted to Kan et al. discloses a device having a circular heating element near the center of a ceiling fan with a second set of blades circulating directly above the heating element so as to direct hot air into the main air flow. Other devices such as U.S. Pat. No. 4,782,213 to Teal and U.S. Pat. No. 4,504,191 to Brown provide for heating elements in the fan blades to heat the air flow generated by the blades. Both such prior art devices involve complicated circuitry and apparatus integral with conventional ceiling fan apparatus must be included at the time of manufacture.

SUMMARY OF THE INVENTION

The present invention involves improved heating apparatus for attaching to an existing conventional ceiling fan to direct heat into the airflow generated by the fan. The apparatus of the present invention is mounted on any conventional ceiling fan having a light kit attachment. The heater is attached mechanically adjacent to the blades of the fan and is electrically connected to the electrical wiring of the fan otherwise used for auxiliary lighting. The heat generated by the heater elements is radiated outward into the airflow where it is directed into the room. Thus the present invention provides a simple and easily-installed heater for any conventional ceiling fan having a light kit attachment so as to substantially heat the airflow from the fan throughout the room.

BRIEF DESCRIPTION OF THE DRAWINGS

The invention will now be described by way of example with reference to the accompanying drawings in which.

DESCRIPTION OF THE PREFERRED EMBODIMENT

Figure 1:
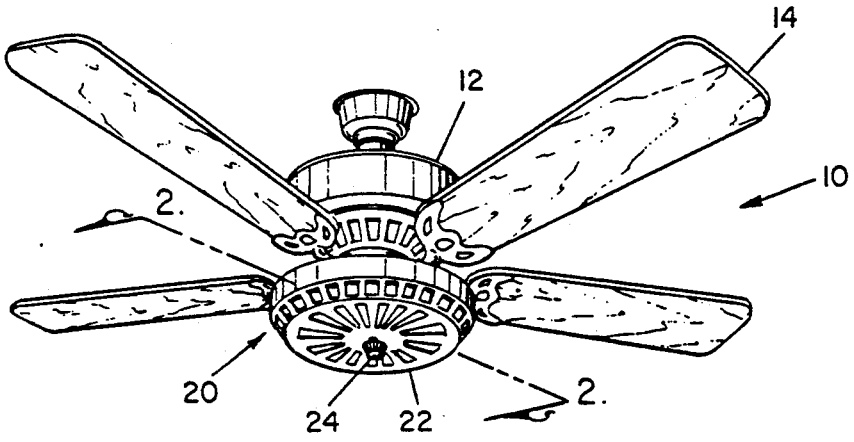
FIG. 1 is a perspective view of a ceiling fan with a preferred embodiment of the heating apparatus of the present invention attached thereto.

FIG. 1 shows a conventional ceiling fan 10 supported from a ceiling and comprising a housing 12 containing a conventional stator/rotor motor (not shown). Four radially-directed blades 14 are equally spaced around the perimeter of the fan assembly and rotate to direct the airflow in a desired direction at a desired speed.

A heater assembly 20 is centrally attached directly below the fan assembly 10. Preferably the heater assembly includes a housing 22 enclosing a plurality of heating elements electrically connected to a conventional power source normally used for a light kit at the center of the fan assembly. A combination on/off switch and thermostat control 24 is disposed in the center of heating assembly 20.

Figure 3:
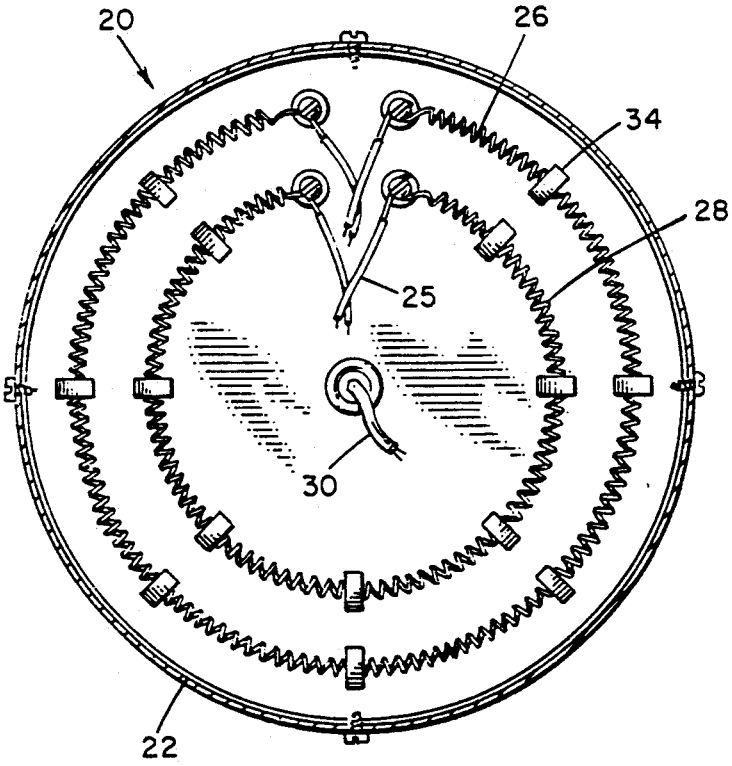
FIG. 3 is a cross-sectional view taken along line 3—3 of FIG. 2.
Figure 2:
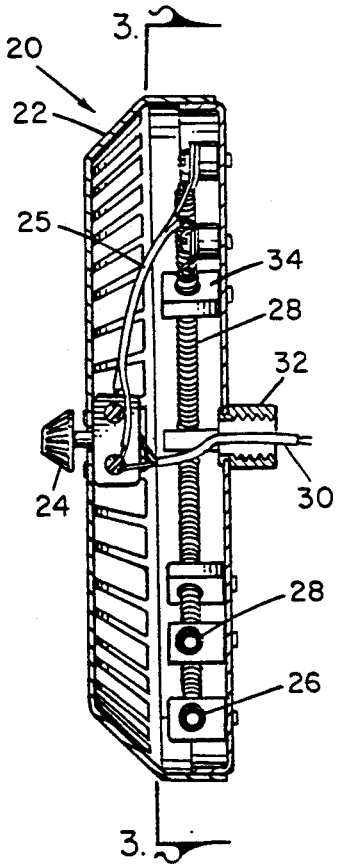
FIG. 2 is a side partial cutaway, partial cross-sectional elevational view of the heating apparatus of FIG. 1.

As shown in FIGS. 2 and 3, annular heating elements 26 and 28 are disposed within housing 22 and electrically connected to the power cord 30 coming from the ceiling fan. Switch 24 is also connected to heating elements 26 and 28 to control power to the elements. Attachment stud 32 at the upper base surface of the housing is used for connecting the heating apparatus mechanically to the ceiling fan assembly.

Heating elements 26 and 28 may be made of any conventional material and are secured by a plurality of suitable connector 34 along the length of each element. The elements may be made of any suitable high resistance heating wire, Calrod-type elements, gas tubes or other suitable means of generating heat.

Figure 4:
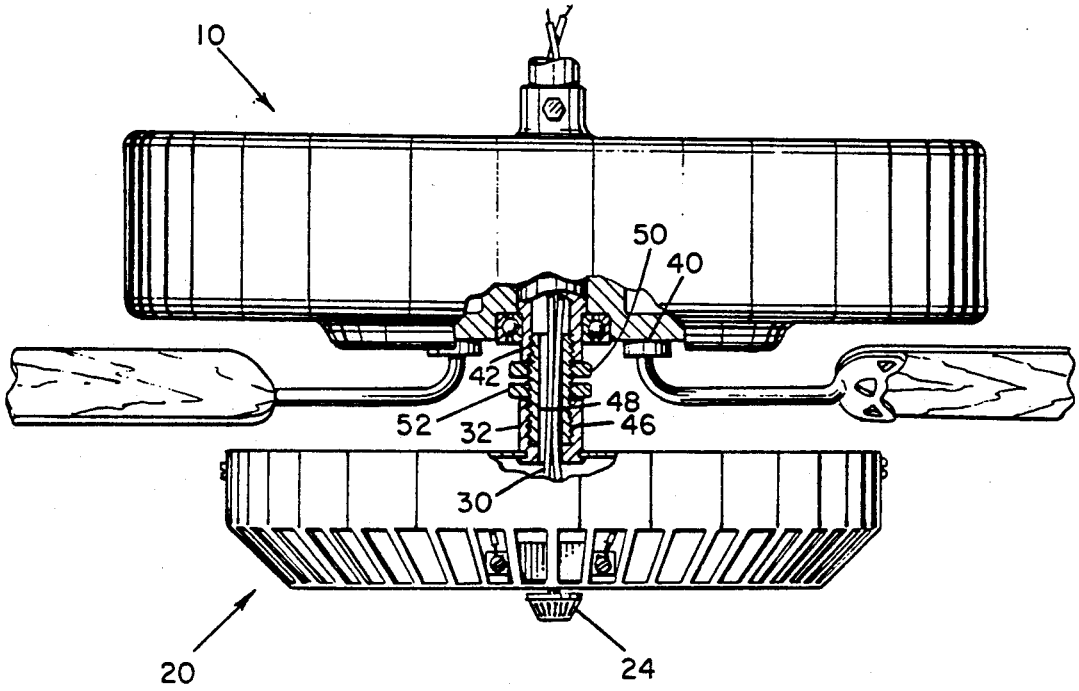
FIG. 4 is a elevational, partially cut-away view of the ceiling fan and heater apparatus shown in FIG. 1.

FIG. 4 shows a partial cross-section of a conventional fan with the heating apparatus attached thereto. Ceiling fan 10 includes an accessory platform 40 having a stud 42 with a threaded bore therein extending downward. Stud 42 is fixedly mounted on the interior of a roller bearing member 43, enabling the fan blades to rotate relative to the fan housing and stud 42.

Heating apparatus 20 includes a threaded stud 32 extending upward. An externally-threaded shaft 46 extends into the threaded bores of studs 42 and 32 to connect the heating apparatus 20 to the ceiling fan 10. Shaft 46 includes an open axially-extending bore 48 through which electrical wiring 30 extends to the heating elements. A lock nut 50 on stud 42 and a lock nut 52 on stud 32 secure shaft 46 in place.

Figure 5:
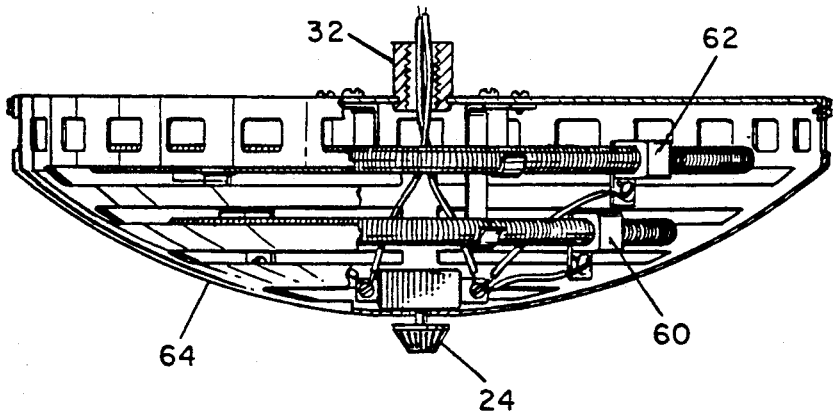
FIG. 5 is an elevational, partial cutaway, partial cross-sectional view of an alternative embodiment of the heating apparatus of the present invention.

FIG. 5 shows an alternative embodiment of the heating apparatus of the present invention wherein two annular conventional heating rods 60 and 62 are axially disposed within a housing 64. Rods 60 and 62 may be of any conventional construction including solid rods or hollow gas tubes for generating heat. 60 and 62 may be offset, as shown in FIG. 5, or stacked vertically as desired.

The above invention provides a simple effective means for attaching a heating apparatus to an existing ceiling fan to inject a substantial amount of heat into the airflow generated by the fan. The heating apparatus may optionally have an individual thermostat as well as an on/off switch, of conventional design, either attached to the fan as shown or located remotely. Each room may thus be heated individually to whatever temperature may be desired without requiring use of a central heat system or cumbersome space heaters. The resulting heating attachment is an attractive addition to an existing ceiling fan which does not require additional usable space and which maintains hot surfaces out of normal contact with people or with potentially flammable material.

While certain novel features of this invention have been shown and described and are pointed out in the annexed claims, it will be understood that various omissions, substitutions and changes in the forms and details of the invention illustrated and in its operation may be made by those skilled in the art without departing from the spirit of the invention.

What is claimed is:

1. In a ceiling fan having a plurality of rotatable blades, a centrally disposed first attachment means at the base of the ceiling fan below the rotatable blades normally used for attaching a conventional lighting fixture and a first electrical connector extending through the first attachment means normally used for attaching to an electrical lead in the lighting fixture, the improvement characterized by a heater assembly comprising:

(a) a housing having a centrally disposed second attachment means for mating with the centrally disposed first attachment means to connect the housing to the ceiling fan below the rotatable blades, (b) a heating element within the housing for generating radiant heat, (c) a second electrical connector connected to the heating element and to the first electrical connector of the ceiling fan to provide electricity from the ceiling fan to the heating element, and (d) vent means in the housing for enabling a flow of air from the rotatable blades of the ceiling fan over the heating elements whereby heat generated in the housing is radiated outward from the housing.

2. A heater assembly adapted to be connected to a ceiling fan having a plurality of rotatable blades driven by a motor and having an electrical connector centrally located, comprising a heating element having an electrical lead adapted to be electrically connected to the connector of the ceiling fan, a housing encompassing the heating element with vents therein for radiating the heat into the airflow generated by the blades of the ceiling fan and attachment means for connecting the housing directly to the ceiling fan below the rotating blades, wherein the attachment means comprises an attachment centrally located on the housing for connecting the housing to the ceiling fan, and wherein the electrical lead extends through said attachment for connection to the electrical connector of the ceiling fan, the attachment including a first stud having a threaded bore in the center of the heater housing for attachment to a second stud having a threaded bore in the center of the fan, and a double threaded shaft for connecting the first and second studs together.

3. A heater assembly for connection to a conventional ceiling fan having a plurality of rotatable blades, a first attachment means at the base of ceiling fan below the rotatable blades for attaching a conventional lighting fixture and a first electrical connector for attaching to an electrical lead in the lighting fixture, comprising:

(a) a housing having a second attachment means for mating with the first attachment means to connect the housing to the ceiling fan below the rotatable blades, (b) a heating element within the housing for generating radiant heat, (c) a second electrical connector connected to the heating element and adapted to extend to the first electrical connector of the ceiling fan to provide electricity from the ceiling fan to the heating element, and (d) vent means in the housing for enabling a flow of air from the rotatable blades of the ceiling fan over the heating elements whereby heat generated in the housing is radiated outward from the housing, (e) wherein the second attachment means is a hollow threaded ember, adapted for attaching to a threaded member on the ceiling fan, through which the second electrical connector extends for connection to the first electrical connector on the ceiling fan.

4. The heater assembly of claim 3 and further comprising a threaded shaft with a longitudinal bore therethrough for screwing into the hollow threaded member of the second attachment means so as to connect to the threaded member on the ceiling fan and through which the second electrical connector extends for connection to the first electrical connector of the ceiling fan.

* * * * *